US005115517A

United States Patent [19]

Ferguson et al.

[11] Patent Number: 5,115,517

[45] Date of Patent: May 26, 1992

[54] SCARF GARMENT

[76] Inventors: Lisa L. Ferguson, 3115 Ave. B, Council Bluffs, Iowa 51501; Susan M. Ludlow, 5314 S. 45th St., Omaha, Nebr. 68117

[21] Appl. No.: 693,807

[22] Filed: Apr. 30, 1991

[51] Int. Cl.[5] ..... A42B 1/04

[52] U.S. Cl. ..... 2/203; 2/84; 2/91; 2/171; 2/202; 2/199; 2/201

[58] Field of Search ..... 2/203, 202, 91, 84, 2/171, 204, 207, 206, 208, 198, 199, 201

[56] References Cited

U.S. PATENT DOCUMENTS

| | | | |
|---|---|---|---|
| 1,203,870 | 11/1916 | Hallam et al. | 2/203 |
| 1,316,778 | 9/1919 | Ensten | 2/203 |
| 1,486,980 | 3/1924 | MacWilliam | 2/203 |
| 2,083,616 | 6/1937 | Rosenberg | 2/203 |
| 2,109,248 | 2/1938 | Hibshman | 2/203 |
| 2,130,933 | 9/1938 | Sweet | 2/203 |

*Primary Examiner*—Werner H. Schroeder
*Assistant Examiner*—Glona Hale
*Attorney, Agent, or Firm*—Zarley, McKee, Thomte, Voorhees & Sease

[57] ABSTRACT

A scarf garment includes an elongated strip of material with upper and lower portions connected along a foldable joint. The ends of the material strip are connectable with fasteners. In a second embodiment of the invention a hood portion is connected to the material strip, along the interface of the strip. The hood is connected intermediate the upper and lower edges of the strip such that the upper portion of the strip may be folded while the hood remains attached to the material strip. The lower portion of the material strip is preferably wider than the upper portion, such that the lower portion will extend downwardly under the collar of a coat worn by a person.

8 Claims, 3 Drawing Sheets

7-F

SCARF GARMENT

TECHNICAL FIELD

The present invention relates generally to scarves, and more particularly to an improved scarf which is adjustable and retractable to cover or reveal portions of the face.

BACKGROUND OF THE INVENTION

Scarves have long been utilized to protect the neck and face from bitter winter winds. However, the main problem with conventional scarves resides in the fact that they do not extend downward past the neck to the extent necessary to prevent wind from entering at the collar.

Furthermore, when a scarf is drawn upwards over the lower portion of the face, it is difficult to keep the scarf tight against the face, so as to prevent the garment from gradually lowering until the face is exposed.

Another problem with prior art scarves resides in the fact that a separate hat must be worn and carried to protect the head. In addition, there is conventionally a space between the hat and scarf which remains uncovered and therefore unprotected from the weather.

It is therefore a general object of the present invention to provide an improved scarf garment which will protect the neck and extend downward under the wearer's coat.

Another object of the present invention is to provide an improved scarf which can be adjusted to various sizes so as to conform to a variety of different people.

A further object is to provide a scarf garment which may be integrally connected with a hat to prevent exposure of any space between the hat and scarf.

Yet another object of the present invention is to provide a scarf garment which may be utilized to cover the face or folded to expose the face, without affecting the remainder of the scarf.

These and other objects will be apparent to those skilled in the art.

SUMMARY OF THE INVENTION

The scarf garment of the present invention includes an elongated strip of material with upper and lower portions connected along a foldable joint. The ends of the material strip are connectable with fasteners. In a second embodiment of the invention a hood portion is connected to the material strip, along the interface of the strip. The hood is connected intermediate the upper and lower edges of the strip such that the upper portion of the strip may be folded while the hood remains attached to the material strip. The lower portion of the material strip is preferably wider than the upper portion, such that the lower portion will extend downwardly under the collar of a coat worn by a person.

DESCRIPTION OF THE PREFERRED EMBODIMENT

Figure 1:
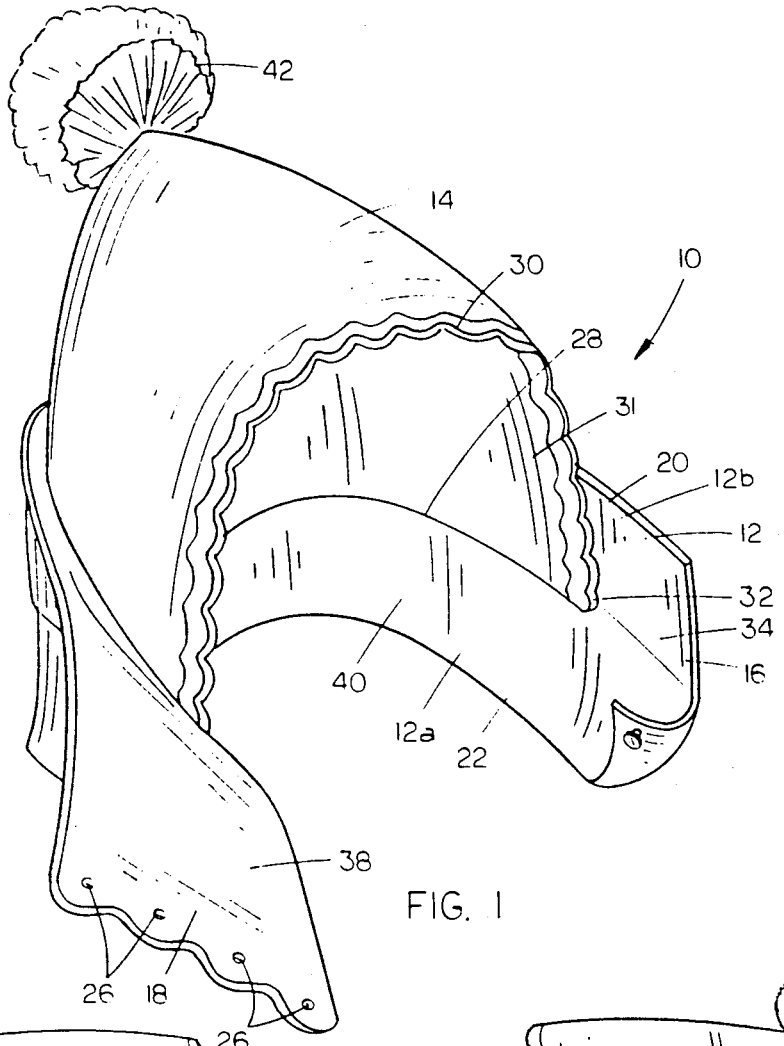
FIG. 1 is a pictorial view of the scarf garment of the present invention.

Referring now to the drawings, in which identical or corresponding parts are identified with the same reference numeral, and more particularly to FIG. 1, the scarf garment of the present invention is designated generally at 10 and includes a scarf portion 12 connected to a hood portion 14.

Figure 2:
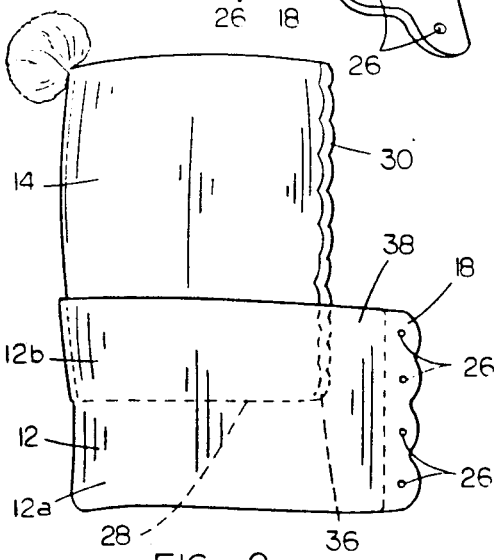
FIG. 2 is a left side elevational view of the scarf of FIG. 1.
Figure 3:
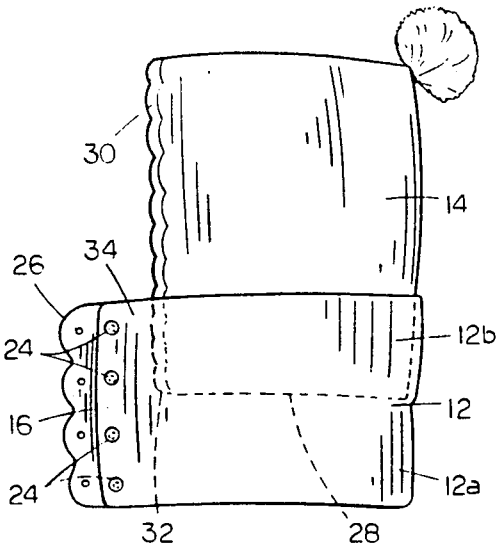
FIG. 3 is a right side elevational view of the scarf of FIG. 1.

Scarf portion 12 is formed from an elongated generally rectangular strip of material having a first end 16, a second end 18, an upper edge 20 and lower edge 22. A series of buttons 24 are affixed along the vertical edge of first end 16, as shown in FIG. 3. Buttons 24 correspond with an identical number of button holes 26 formed along the vertical edge of second end 18 as shown in FIGS. 1 and 2. Preferably, scarf portion 12 is formed from a material which is stretchable, such that the garment 10 will fit persons having various neck dimensions.

Hood portion 14 includes a bottom edge 28 which is fastened to scarf portion 12 between the upper and lower edges 20 and 22 thereof. A forward, edge 30 on hood portion 14 surrounds the forward opening 31 for the person's face. Forward edge 30 joins bottom edge 28 at a right junction 32 to form a right flap 34 formed by that portion of scarf 12 between right junction 32 and first end 16. Forward edge 30 also joins bottom edge 28 at a left junction 36 (see FIG. 2) to form a left flap 38.

Preferably, hood portion 14 is affixed to scarf portion 12 slightly off center, such that left flap 38 is longer than right flap 34. In this way, the buttons and button holds will not be directly aligned with the center of the face, so as to prevent air leakage through the fastener connection when facing directly into the wind. In addition, hood portion 14 must be connected to scarf portion 12 along the interior face 40 of scarf portion 12 as described in more detail herein below. A decorative ball 42 may be added to the hood as desired.

It is also preferred that bottom edge 28 be fastened along scarf portion 12 above the mid line between lower edge 22 and upper edge 20, such that the lower portion **12*a* of scarf 12 below bottom edge 28 is greater than the upper portion 12*b* located above bottom edge 28**.

Figure 5:
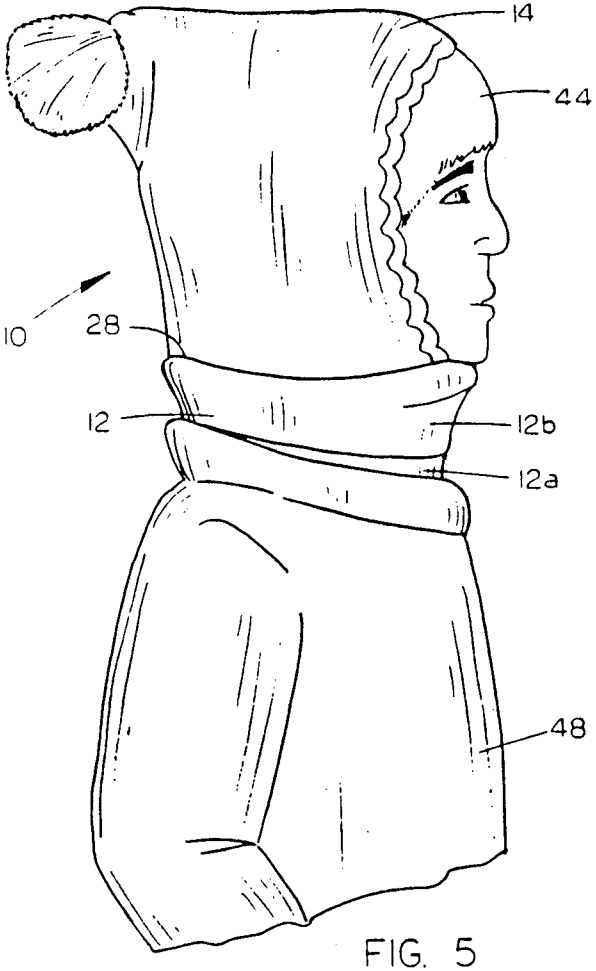
FIG. 5 is a view similar to FIG. 4, with the scarf portion of the garment folded down to expose the face.
Figure 4:
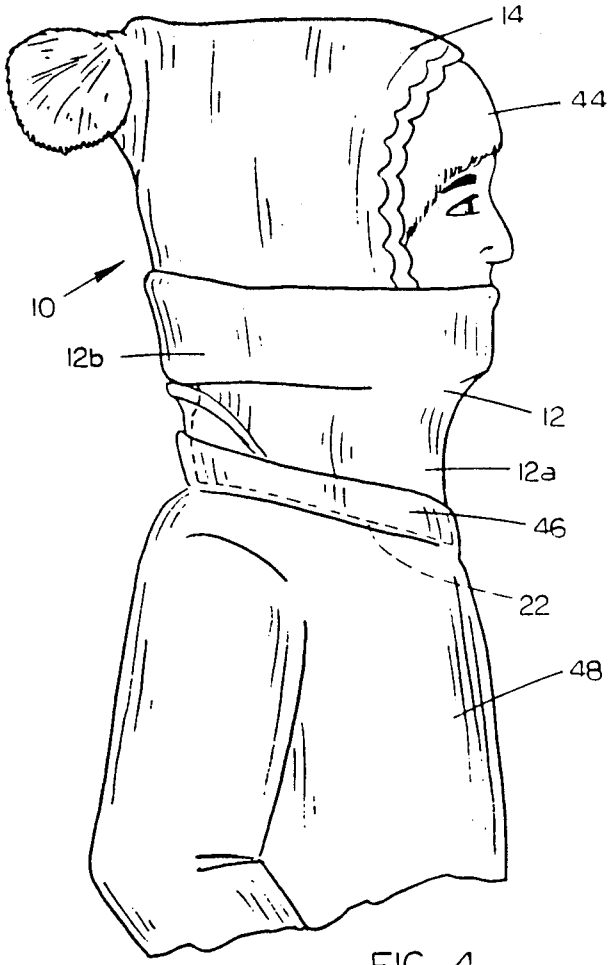
FIG. 4 is a left side elevational view of a person wearing the scarf of FIG. 1.

Referring now to FIGS. 4 and 5, the scarf garment 10 is shown worn by a person 44. In FIG. 4, scarf portion 12 is in its fully extended position with upper scarf portion **12*b* covering the lower half of the person's face, and lower scarf portion 12*a* covering the person's neck and extending below the collar 46 of the person's jacket 48. The extra length of lower portion 12*a* permits the lower edge 22 of scarf 12 to extend below collar 46**.

Because hood 14 is affixed to the interior face of scarf 12, upper scarf portion **12*b* maybe folded down to its juncture with bottom edge 28 of hood portion 14 to expose the person's face as shown in FIG. 5. Because the fasteners are located off center, they cannot be seen in FIGS. 4 and 5**.

Figure 7:
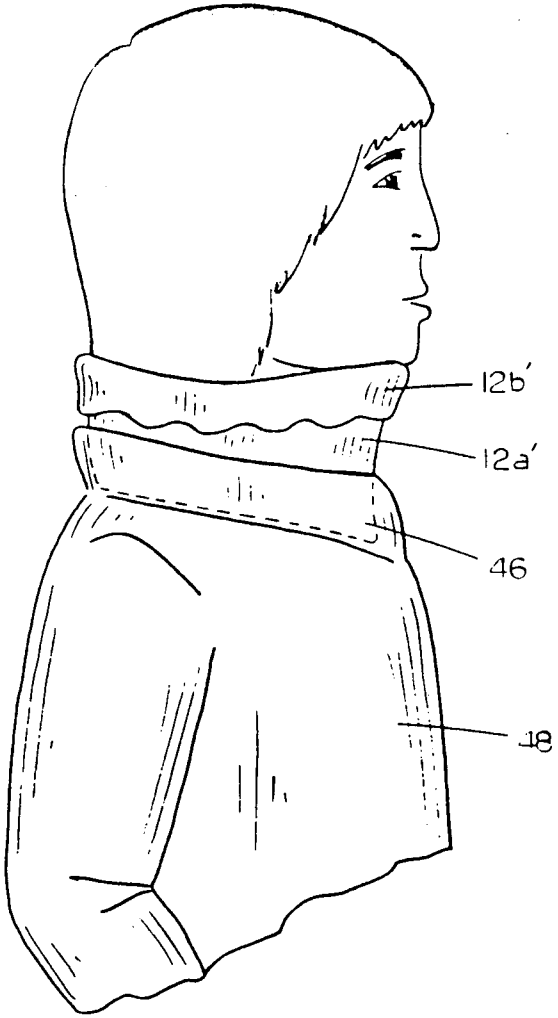
FIG. 7 is a left side elevational view of a person wearing the embodiment of the invention shown in FIG. 6.
Figure 6:
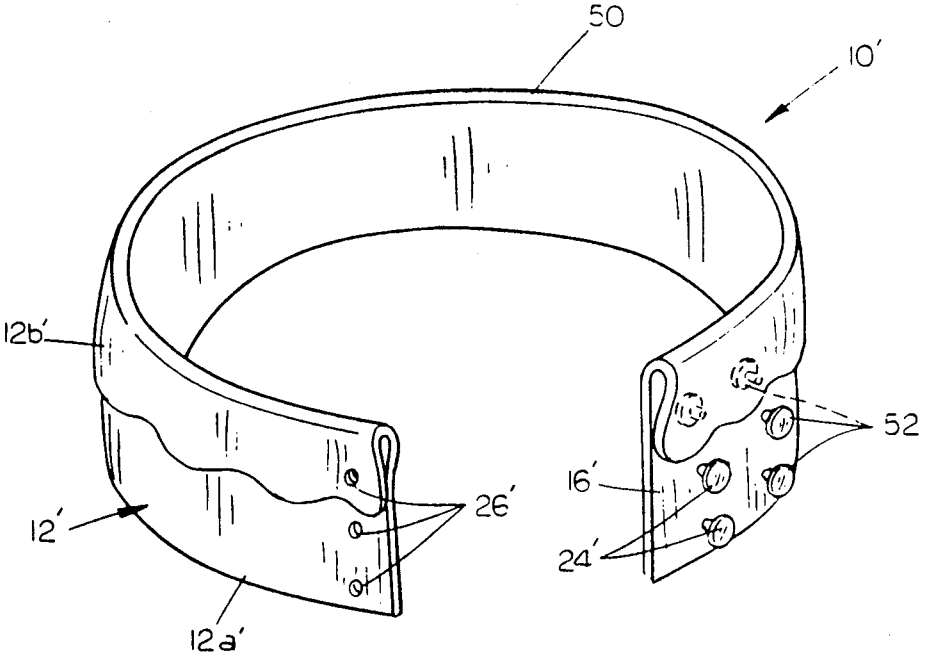
FIG. 6 is a second embodiment of the scarf garment of the present invention.

Referring now to FIGS. 6 and 7, a second embodiment of the invention is designated generally at 10' and includes a scarf portion 12' which has no hood connected thereto. Scarf 12' includes a lower, single sheet of material with a scarf portion 12a', and, an upper scarf portion 12b', folded over to depend from a fold 50. As in the first embodiment it is preferred that lower portion scarf 12a, is longer than upper scarf portion 12b, such that lower scarf portion 12a' will be worn under the collar 46 of the wearer's jacket 48 as shown in FIG. 7.

In the second embodiment of scarf garment 10', a first set of buttons 24' are mounted along first end 16' in a fashion similar to the first embodiment. A second set of buttons 52 are mounted parallel and spaced away from the first set of buttons 24'. In this fashion, button holes 26' may be fastened on either the first set of buttons 24' or the second set of buttons 52.

Since a second set of button 52 are utilized, the material of scarf 12' need not be stretchable.

Whereas the invention has been shown and described in connection with the preferred embodiments thereof, it will be understood that many modifications, substitutions and additions may be made which are within the intended broad scope of the appended claims. For example, various types of fasteners such as snaps or the like may be utilized in place of the buttons disclosed herein. In order to provide adjustability, a series of elastic loops could be provided which would hook on a single set of buttons. Velcro and other fasteners would also work to permit adjustable fastening of the scarf around the neck.

There has therefore been shown and described an improved scarf garment which accomplishes at least all of the above states objects.

We claim:

1. A scarf garment comprising:

an elongated strip of material having first and second ends, upper and lower edges and inner and outer faces;

said strip having a generally horizontal foldable joint between upper and lower portions such that the upper portion will fold and overlap the lower portion with the outer faces of the upper and lower portions abutting together;

means for connecting said first and second ends to form a closed loop.

2. The garment of claim 1, wherein said lower portion has a greater height, as measured from the lower edge to the foldable joint, than the upper portion such that the upper portion will overlap only a portion of the lower portion.

3. The garment of claim 1, further comprising a hood portion connected to said strip, for covering at least a portion of a person's head.

4. The garment of claim 3, wherein said hood portion includes:

a bottom edge, having right and left ends, connected along its entire length to the inner face of said strip;

said bottom edge located parallel to said strip lower and upper edges; and a front edge extending between said right and left ends of said bottom edge, to form a front opening to expose a person's face.

5. The garment of claim 4, wherein said good bottom edge has a length less than the length of said strip, and wherein said bottom edge is mounted intermediate the first and second ends of said strip to form a first flap between the right end of the bottom edge and the first strip end, and a second flap between the left end of the bottom edge and the second strip end.

6. The garment of claim 5, wherein said bottom edge is mounted to form the right flap with a length shorter than the left flap.

7. The garment of claim 4, wherein said bottom edge is mounted to said strip along said foldable joint.

8. The garment of claim 1, wherein said means for connecting said first and second ends includes means for adjustably connecting the first and second ends to form a closed loop adjustable in diameter.

* * * * *